US008766905B2

(12) United States Patent
Adachi

(10) Patent No.: US 8,766,905 B2
(45) Date of Patent: Jul. 1, 2014

(54) BACKLIGHT DEVICE HAVING A LIGHT EMITTING DIODE DRIVING PART AND LIQUID CRYSTAL DISPLAYING DEVICE USING THE BACKLIGHT DEVICE

(75) Inventor: Takeshi Adachi, Kumagaya (JP)

(73) Assignees: Mitsumi Electric Co., Ltd., Tokyo (JP); ATRC Corporation, Saitama (JP)

( * ) Notice: Subject to any disclaimer, the term of this patent is extended or adjusted under 35 U.S.C. 154(b) by 263 days.

(21) Appl. No.: 12/738,071

(22) PCT Filed: Nov. 11, 2008

(86) PCT No.: PCT/JP2008/070520

§ 371 (c)(1),
(2), (4) Date: Apr. 14, 2010

(87) PCT Pub. No.: WO2009/063874

PCT Pub. Date: May 22, 2009

(65) Prior Publication Data

US 2010/0231573 A1 Sep. 16, 2010

(30) Foreign Application Priority Data

Nov. 13, 2007 (JP) ..... 2007-294189
Oct. 20, 2008 (JP) ..... 2008-270221

(51) Int. Cl.
*G09G 3/36* (2006.01)

(52) U.S. Cl.
USPC ..... 345/102

(58) Field of Classification Search
CPC ..... G09G 3/3426
USPC ..... 345/102, 211
See application file for complete search history.

(56) References Cited

U.S. PATENT DOCUMENTS 4,233,602 A * 11/1980 Hanmura ..... 345/55
5,130,829 A * 7/1992 Shannon ..... 349/111
6,290,368 B1 * 9/2001 Lehrer ..... 362/187
7,113,164 B1 9/2006 Kurihara
7,737,930 B2 6/2010 Inuzuka et al.
7,944,430 B2 * 5/2011 Jung et al. ..... 345/102

(Continued)

FOREIGN PATENT DOCUMENTS

CN 1892784 1/2007
JP 07-191311 7/1995

(Continued)

OTHER PUBLICATIONS

Machine based English translation of JP 2001142409 A.*

(Continued)

*Primary Examiner* — Chanh Nguyen
*Assistant Examiner* — John Kirkpatrick
(74) *Attorney, Agent, or Firm* — IPUSA, PLLC

(57) ABSTRACT

A backlight device which uses a light emitting diode as a light source, the back light device being configured to irradiate a liquid crystal display panel from a rear surface of the liquid crystal display panel, the backlight device having a structure where plural lines are provided on a backlight board with a certain gap, each of the lines being where plural of the light emitting diodes are provided, the backlight device includes a light emitting diode driving part configured to segment an entire screen of the backlight board into plural segmented regions and configured to independently control brightness of the light emitting diodes with a segmented region unit.

5 Claims, 13 Drawing Sheets

(56) References Cited

U.S. PATENT DOCUMENTS

| | | | | |
|---|---|---|---|---|
| 2003/0090455 | A1* | 5/2003 | Daly | 345/102 |
| 2003/0132907 | A1* | 7/2003 | Lee et al. | 345/98 |
| 2006/0290627 | A1 | 12/2006 | Konno et al. | |
| 2007/0002000 | A1 | 1/2007 | Kwon | |

FOREIGN PATENT DOCUMENTS

| | | | | |
|---|---|---|---|---|
| JP | 2001142409 | A * | 5/2001 | G09F 9/00 |
| JP | 2002-006815 | | 1/2002 | |
| JP | 2004-191490 | | 7/2004 | |
| JP | 2006-145798 | | 6/2006 | |
| JP | 2007-003805 | | 1/2007 | |
| JP | 2007-086390 | | 4/2007 | |
| JP | 2008-070558 | | 3/2008 | |
| WO | WO 2007017795 | A2 * | 2/2007 | G09G 3/34 |

OTHER PUBLICATIONS

Bickle, Rick. 'A Simple PWM Circuit Based on the 555 Timer'. In Tutorials, Dallas Personal Robotics Group [online]. Dallas, (TX): Nov. 2005; [retrieved on May 6, 2013]. Retrieved from the Internet: <URL: www.dprg.org/tutorials/2005-11a/>.*

Japanese Office Action mailed on Oct. 18, 2011.

Chinese Office Action dated Feb. 16, 2012.

Chinese Office action mailed Aug. 13, 2012 with partial English translation.

* cited by examiner

BACKLIGHT DEVICE HAVING A LIGHT EMITTING DIODE DRIVING PART AND LIQUID CRYSTAL DISPLAYING DEVICE USING THE BACKLIGHT DEVICE

TECHNICAL FIELD

The present invention generally relates to backlight devices where light emitting diodes are used at rear surfaces of color liquid crystal display panels and liquid crystal displaying devices using the back light devices. More specifically, the present invention relates to a structure or a driving method of a light emitting diode whereby low consumption of electric power and high quality imaging are realized at low costs.

BACKGROUND ART

At present, a type where a transmission liquid crystal display panel having a color filter is irradiated from a rear surface side by a backlight device so that a color image is displayed has been a mainstream type of a liquid crystal displaying device. In addition, although a CCFL (Cold Cathode Fluorescent Lamp) using a fluorescent tube has been conventionally and widely used as the backlight device, there is a limitation of use of mercury from the perspective of the environment. As a light source instead of the CCFL using the mercury, an LED (Light Emitting Diode) has been used. (See, for example, Patent Document 1.)

The liquid crystal panel backlight device can be classified into two types, namely an edge type or a direct type, depending on arrangement of the light source. In the edge type, a light guide plate is provided right under a rear surface of the liquid crystal panel and a light source is provided at a side surface part of the light guide plate. The edge type is used for a relatively small liquid crystal panel such as a mobile phone or a display of a notebook-type personal computer. In addition, in the direct type, the light source is provided right under the rear surface of the liquid crystal panel and is used for a large size liquid crystal panel because the direct type has a better utilization rate of light and less weight than the edge type.

In the direct type backlight device where the light emitting diode is used as the light source, there are two kinds of lighting ways. One is a way where a white color light emitting diode is used as the light source. Another is a way where a light emitting diode irradiating three primary colors, namely a red light, a green light, and a blue light, is used and a white light is obtained based on a mixture of the red light, the green light, and the blue light. There are two kinds of arrangement of the light emitting diodes in the direct type backlight device. One is, as shown in FIG. 1, where the light emitting diodes are uniformly arranged at the rear surface of the liquid crystal panel. Another is, as shown in FIG. 2, where the light emitting diodes are arranged in a line state, like a conventional CCFL (fluorescent tube). The arrangement shown in FIG. 1 is used for large size liquid crystal television screens or liquid crystal monitors. The arrangement shown in FIG. 2 is used for middle size liquid crystal television screens or liquid crystal monitors.

However, in the backlight device using the light emitting diodes arranged as discussed above, as well as the backlight device using the conventional CCFL, the light emitting diodes are always lighted at the time when the liquid crystal displaying device is being used. Accordingly, lower consumption of the electric power is further required. Because of this, as discussed in Patent Document 2, a structure has been suggested where the backlight is segmented into plural sub-units and brightness of the light emitting diodes are adjusted for every sub-unit so that the lower consumption of the electric power is achieved.

[Patent Document 1] Japanese Patent Application Laid-Open Publication No. 7-191311

[Patent Document 2] Japanese Patent Application Laid-Open Publication No. 2004-191490

DISCLOSURE OF THE INVENTION

Problems to be Solved by the Invention

The method, as discussed in Patent Document 2, where the backlight is segmented into plural sub-units and luminance of a surface image region corresponding to the sub-unit is adjusted, can be performed by the backlight device, as shown in FIG. 1, where the light emitting diodes are uniformly arranged right under the displaying device. However, in the backlight device, as shown in FIG. 2, like a conventional CCFL, where the light emitting diodes are arranged in a line state, although the brightness of the entirety of the backlight can be controlled and brightness of the backlight can be changed for every line, there is no way that the backlight can be segmented into regions and brightness can be controlled for every region. Depending on the contents of an image signal, a size or a place of a region where luminance of a display surface is expected to be changed varies. Therefore, if the brightness can be changed for only every line unit as discussed above, it is difficult to realize a proper image.

Means for Solving Problems

Accordingly, embodiments of the present invention may provide a novel and useful backlight device and liquid crystal displaying device using the backlight device solving one or more of the problems discussed above.

More specifically, the embodiments of the present invention may provide a backlight device whereby even if the light emitting diodes are arranged horizontally or vertically in a line state as shown in FIG. 2 as a direct type backlight device, it is possible to control the brightness of the backlight for every region, depending on the contents of the image signal, and a liquid crystal displaying device using the backlight device.

One aspect of the present invention may be to provide a backlight device which uses a light emitting diode as a light source, the back light device being configured to irradiate a liquid crystal display panel from a rear surface of the liquid crystal display panel, the backlight device having a structure where plural lines are provided on a backlight board with a certain gap, each of the lines being where plural of the light emitting diodes are provided, the backlight device including a light emitting diode driving part configured to segment an entire screen of the backlight board into plural segmented regions and configured to independently control brightness of the light emitting diodes with a segmented region unit.

With this structure, it is possible to control brightness of a light source with a segmented region unit so that proper control can be performed depending on the contents of the image signal.

The backlight device further includes a segmented region setting part configured to optionally set a size of the segmented region.

With this structure, it is possible to change the size of a region to be segmented and proper control suitable for contents to be controlled such as the contents of the image signal or luminance or size of a screen can be performed.

The segmented region setting part may be configured to set the size of the segmented region so as to change the size of the segmented region based on contents of an image signal; and the backlight device may further include a luminance control part configured to control brightness of the segmented region based on the contents of the image signal.

With this structure, it is possible to control, depending on the contents of the image signal, the size of the region to be segmented and control luminance of the segmented region.

The backlight device as claimed in claim 1, further includes a part configured to turn on the plural lines in order.

With this structure, it is possible to drive the line in order in the region segmented in a plural manner so that the low consumption of the electric power is achieved.

The light emitting diode may be formed by a combination of a white light emitting diode, a red light emitting diode, a green light emitting diode and/or a blue light emitting diode.

With this structure, it is possible to combine various kinds of the light emitting diodes so that a proper combination depending on the use of the light emitting diodes can be made.

Another aspect of the present invention may be to provide a liquid crystal displaying device, including the backlight device mentioned above, a liquid crystal display panel provided at a front surface of the backlight device, the liquid crystal display panel being configured to display an image in a state where the liquid crystal display panel is irradiated by the backlight device; a source driver and a gate driver configured to drive the liquid crystal display panel; and a liquid crystal panel control circuit configured to control With this structure, it is possible to properly control light from the backlight, corresponding to a display image of the liquid crystal displaying panel.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

Effect of the Invention

According to the embodiment of the present invention, it is possible to provide a backlight device, whereby even if the light emitting diodes are arranged in a line state, it is possible to realize the low consumption of the electric power by decreasing the brightness of the backlight corresponding to, for example, a dark region of a displaying screen, corresponding to the contents of the image signal, and it is possible to control the brightness of the backlight with a region unit corresponding to the contents of the image signal so that high quality image displaying can be made, and provide a liquid crystal displaying device using the backlight device. Especially, it is possible to achieve the practical effect of low price middle size liquid crystal television screens or liquid crystal monitors.

EXPLANATION OF REFERENCE SIGNS

Figure 1:
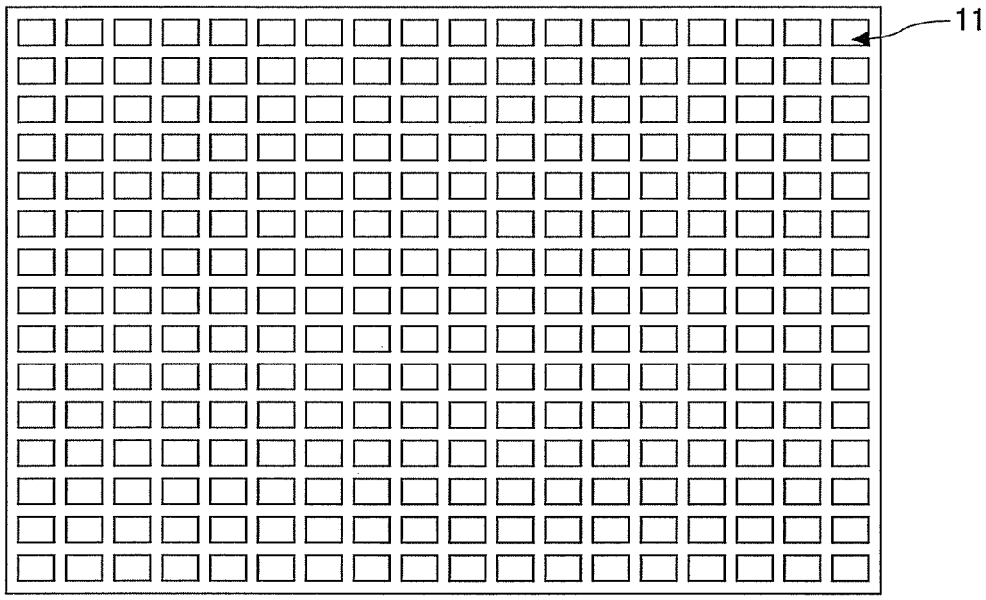
FIG. 1 is a view showing an arrangement of light emitting diodes in a direct type backlight device.

11 Light emitting diode
21 Line
31, 61, 41 Segmented region
51, 61, 81, 83, 91, 101 X driver (horizontal direction driving)
52, 62, 72, 82, 84, 92, 102 Y driver (vertical direction driving)
73, 93 Ring counter
74, 94 Drive amplifier
100 Backlight board
110, 111, 112, 113, 114 Integrating part
120 Control part
140 Luminance detecting part
150 Segmented region setting part
160 Luminance control part
170 Light emitting diode driving part
200 Backlight device
210 Image signal processing circuit
220 Memory

230 Liquid crystal panel control circuit
240 Source driver
250 Gate driver
260 Liquid crystal display panel
300 Liquid crystal displaying device

BEST MODE FOR CARRYING OUT THE INVENTION

A description is given below, with reference to FIG. 2 through FIG. 14 of embodiments of the present invention.

Figure 2:
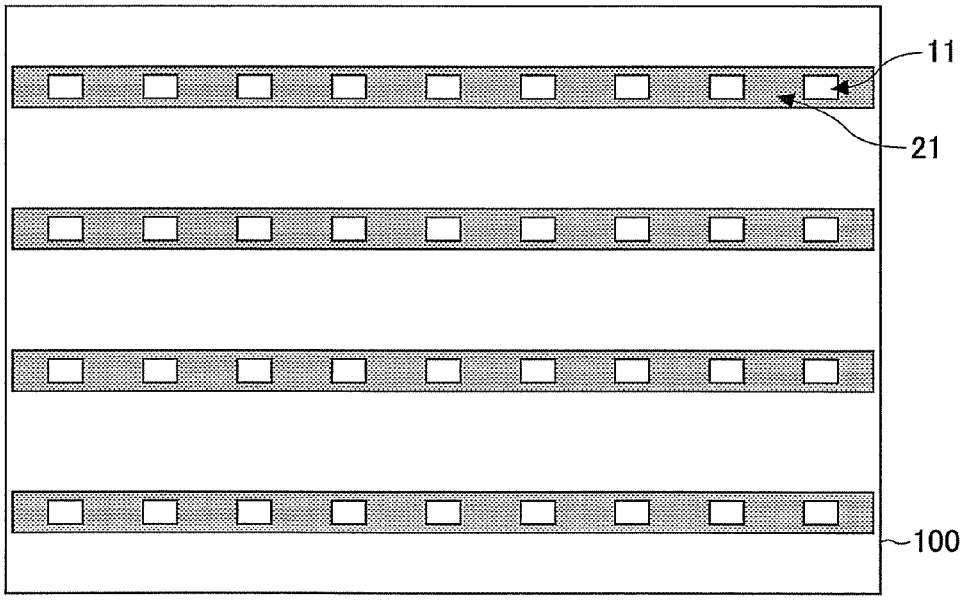
FIG. 2 is a view showing an arrangement of light emitting diodes in a backlight device of the present invention.

A case where a white light emitting diode is used as a light source of a backlight is discussed as an example of the present invention. FIG. 2 is a view showing an example of an arrangement of light emitting diodes on a backlight board 100 of a backlight device of the present invention. The structure shown in FIG. 2 is formed by basically, the CCFL of the conventional backlight device being replaced with the light emitting diodes, and techniques applied to the CCL can be applied to this structure. As shown in FIG. 2, plural lines 21, on each of which light emitting diodes 11 are provided with proper gaps, are provided side by side with the substantially equal gaps.

Figure 3:
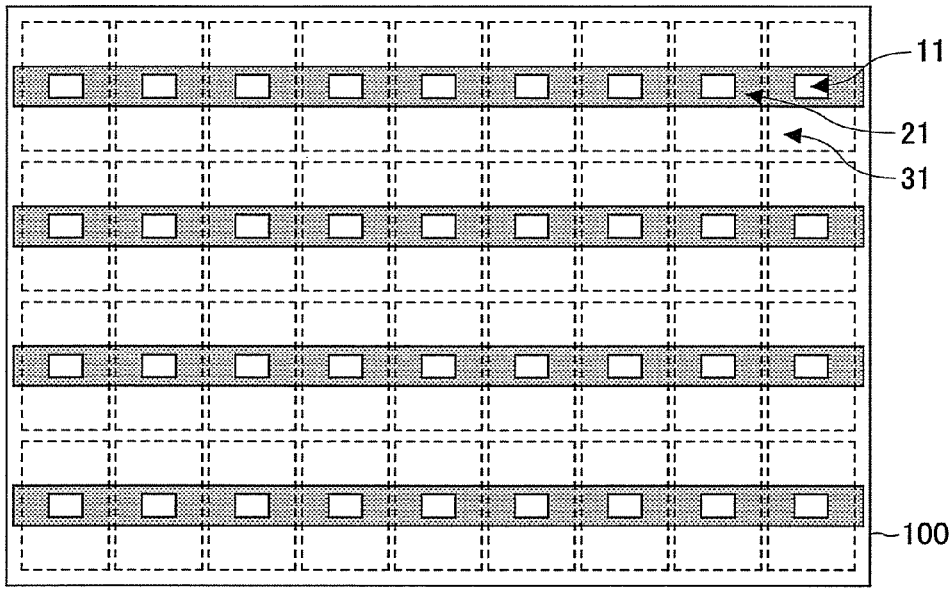
FIG. 3 is a view showing a region segmentation of the backlight device of the present invention.

Next, region segmentation of the backlight of the embodiment of the present invention is discussed. FIG. 3 shows an example of the backlight board 100. In this example, four lines 21 where the light emitting diodes 11 are provided horizontally and in a line state are used as the backlight. Each line 21 has nine emitting diodes 11 provided horizontally. Since four lines 21 are provided, tetra-segmentation in a vertical direction can be made. In addition, by independently controlling an electric current flowing in each of the nine light emitting diodes 11 provided in a horizontal direction, it is possible to make nine-segmentation as maximum, as shown by a frame with a dotted line in FIG. 3.

Figure 4:
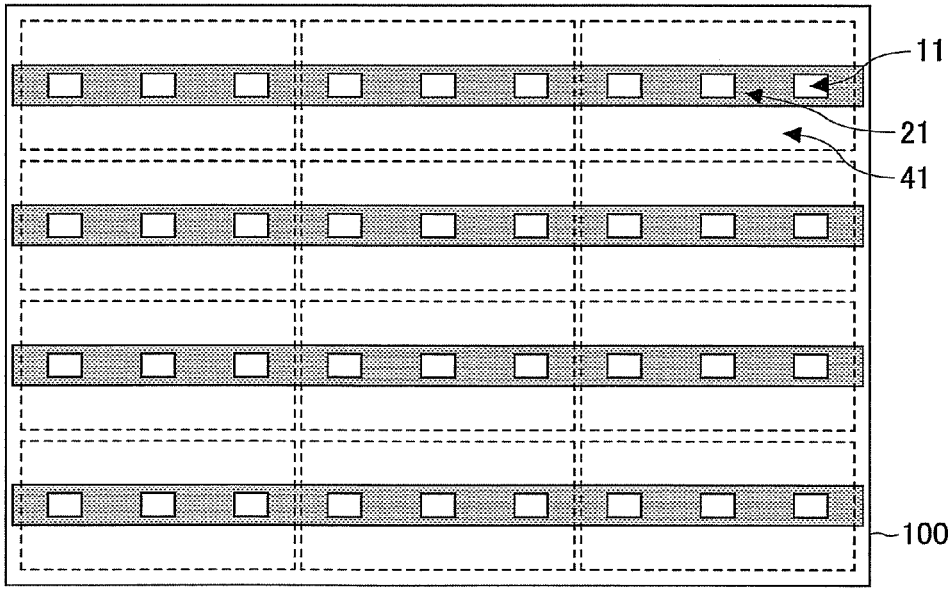
FIG. 4 is a view showing another example of the region segmentation of the backlight device of the present invention.

In addition, another example of the region segmentation of the backlight on the backlight board 100 is shown in FIG. 4. In this example, as well as the example shown in FIG. 3, tetra-segmentation in a vertical direction is made. Tri-segmentation is made in a horizontal direction in this example. In this case, the light emitting diodes 11 on each of the lines 21 can be controlled as three-piece units. The brightness of the backlights can be controlled by making tri-segmentation, as maximum, in the horizontal direction. In the examples shown in FIG. 3 and FIG. 4, four lines 21 are arranged and nine light emitting diodes 11 are arranged on each line 21. However, there is no limitation to the number of the light emitting diodes 11 and the number of the lines 21.

According to an embodiment of the present invention, in a direct type backlight device where the light emitting diodes are arranged in a line state, by segmenting the backlight into plural regions and providing a part configured to control the brightness for every segmented region, it is possible to control the brightness of the backlight with a unit of regions segmented based on luminance of an image signal. Hence, it is possible to obtain high quality images and reduce consumption of electric power by the backlight, by making the backlight dark in a region where a luminance level of the image signal is low and by making the backlight bright in a region where a luminance level of the image signal is high.

Figure 5:
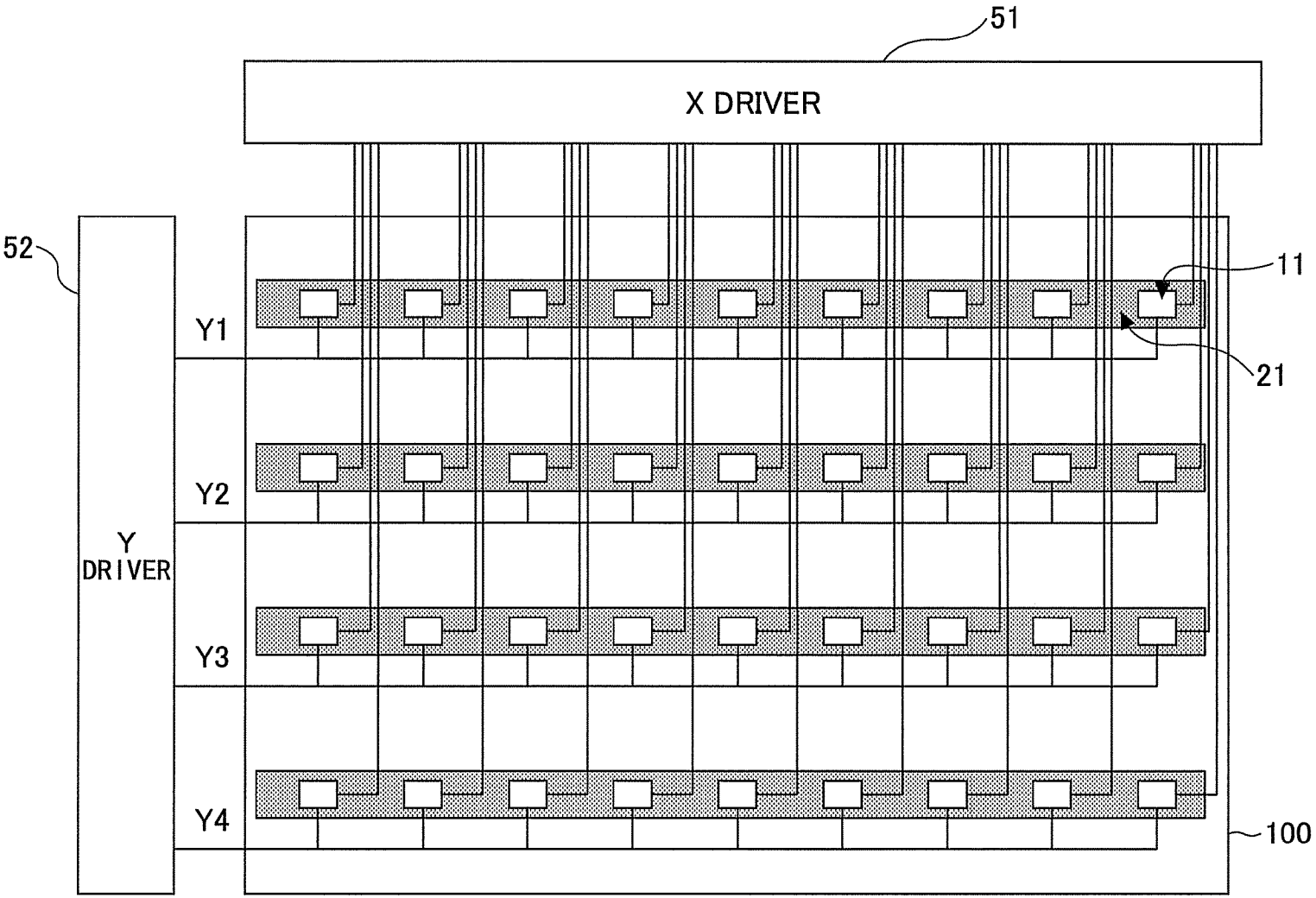
FIG. 5 is a view for explaining driving of a light emitting diode of the backlight device of the present invention.

Next is discussed driving of the light emitting diodes of the backlight device of the example where the present invention is applied. FIG. 5 shows an example of the driving of the light emitting diodes of embodiments of the present invention. In the example shown in FIG. 5, an X driver 51 is a driving circuit in a horizontal direction of a large number of the light emitting diodes 11 forming the backlight. A Y driver 52 is a driving circuit in a vertical direction of the light emitting diodes 11. As shown in FIG. 5, each of the light emitting diodes 11 provided on the backlight board 100 is connected to the X driver 51 independently from other light emitting diodes 11. The light emitting diodes 11 are connected to the Y driver 52 with a line unit. For example, all of the light emitting diodes 11 provided on a line Y1 are connected to the Y driver 52 with a single line. In the vertical direction, each of the lines Y1, Y2, Y3, and Y4 can be independently controlled by the Y driver 52, and in the horizontal direction, the light emitting diode 11 can be controlled, as a single unit, by the X driver 51.

However, in a case where the number of segmentations in the horizontal direction may be substantially the same as that in the vertical direction, the tri-segmentation is made in the horizontal direction as shown in FIG. 4. In this case, as shown in FIG. 4, the light emitting diodes 11 are controlled where three light emitting diodes 11 in the horizontal direction are used as a set. In the above-discussed driving method, it is possible to individually and independently control the electric current for each of the light emitting diodes 11. Therefore, even if there is unevenness of luminance of the light emitting diodes 11, it is possible to correct the unevenness by adjusting, in advance, the electrical current flowing to each of the light emitting diodes 11.

Figure 6:
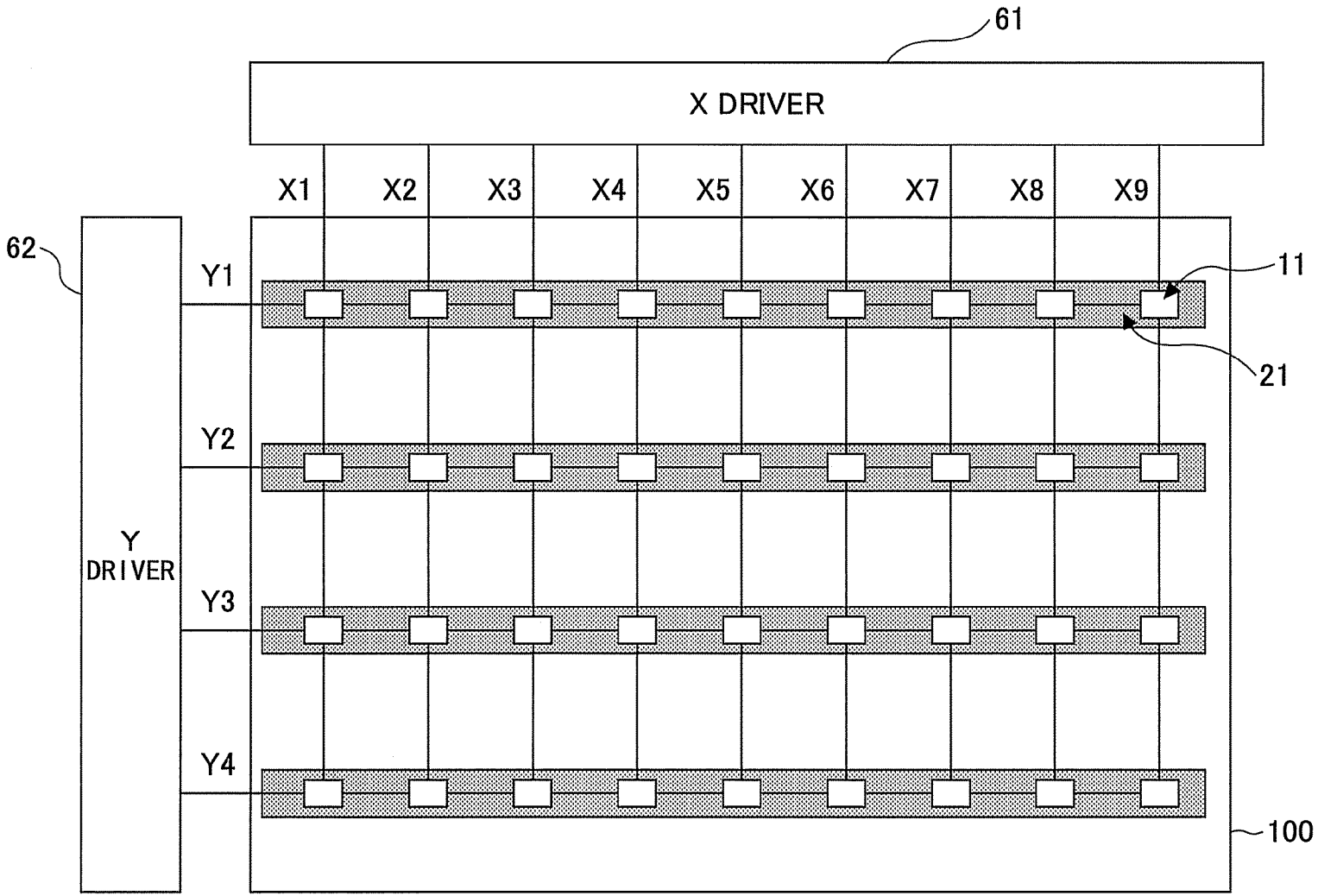
FIG. 6 is a view for explaining another driving of the light emitting diode of the backlight device of the present invention.

As another example where the light emitting diodes 11 are driven, a case where the light emitting diodes 11 are lighted (turned on) in order is discussed. FIG. 6 is a view showing a plane structure of a backlight device of an example where the light emitting diodes 11 are lighted in order. In the example shown in FIG. 6, as well as the example shown in FIG. 5, the lines 21 of the light emitting diodes 11 on the backlight board 100 are connected to the Y driver 62 separated in the vertical direction. The lines 21 are selected not simultaneously but in order such as in the order of Y1, Y2, Y3, and Y4 from the upper one. Furthermore, in the horizontal direction, as shown in FIG. 6, the light emitting diodes 11 arranged in mutually vertical directions on the lines are connected to the X driver 61. In other words, the light emitting diodes 11 arranged at the left-most of the lines Y1, Y2, Y3 and Y4 are connected to the X driver 61 by a single line. Similarly, the light emitting diodes 11 arranged at the 2nd left-most of the lines Y1, Y2, Y3 and Y4 are connected to the X driver 61 by a single line. Hence, the number of wirings between the X driver 61 and the light emitting diodes 11 may be the same as the number of the light emitting diodes 11 arranged in the horizontal directions so that a structure may be simple. In addition, the light emitting diodes 11 are lighted not simultaneously but in order, so that low consumption of the electric power can be achieved.

Figure 7A:
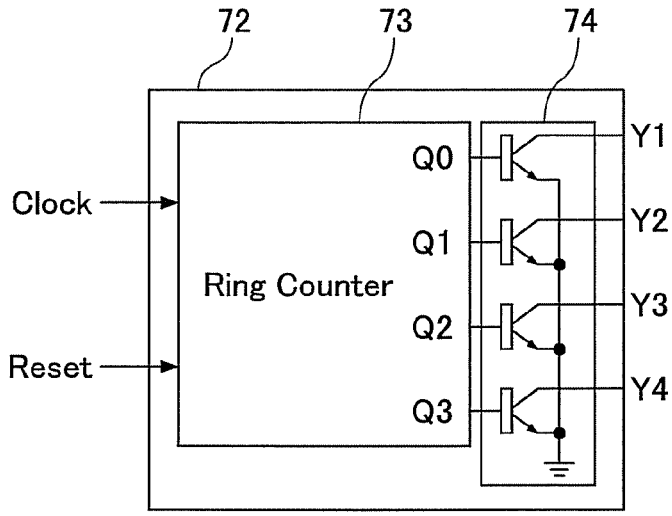
FIG. 7A is a view showing an example block diagram of a driving circuit of a vertical direction Y driver 72.
Figure 7B:
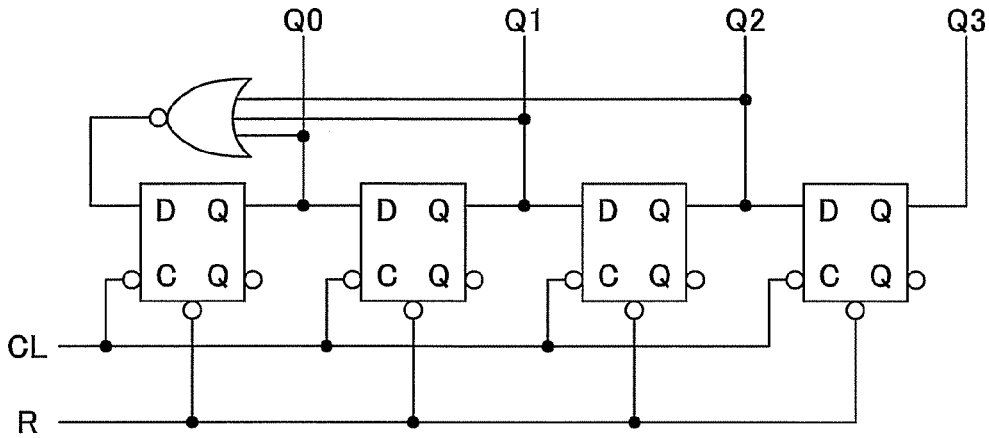
FIG. 7B is a view showing an example circuit diagram of a four-step ring counter 73.
Figure 7C:
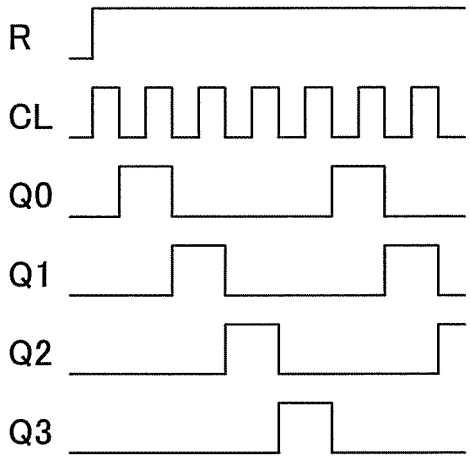
FIG. 7C is a view showing an example of relationships between waveforms of parts of the ring counter 73 and timing.

Next, details of a driving method in the vertical direction of a line order lighting type are discussed with reference to FIG. 7A through FIG. 7C. FIG. 7A through FIG. 7C show an example of an internal structure of a vertical direction Y driver 72. FIG. 7A is a view showing an example block diagram of a driving circuit of the vertical direction Y driver 72. FIG. 7B is a view showing an example circuit diagram of a four-step ring counter 73. FIG. 7C is a view showing an example of relationships among waveforms of each part of the ring counter 73 and timing. The ring counter 73 outputs Q0, Q1, Q2, and Q3 in order for every one cycle of the input clock signal. The light emitting diodes 11 on the lines 21 can be selected in order via a drive amplifier 74 by the output. In the above-discussed examples, a case where four lines 21 are provided is discussed. However, the present invention is not limited to this example. If the number of the lines 21 is "n", an "n"-step structure is provided in the ring counter.

However, in the case of the line order driving discussed above, as shown as a waveform in FIG. 7C, a duty cycle of an output pulse of the four-step ring counter 73 is 25%. In a case where it is necessary to make the number of the lines 21 larger, such as a case where it is used for a relatively large liquid crystal television screen, the duty cycle is too low so that the backlight may be dark. In a case where a large number of the lines 21 are necessary, the light emitting diodes 11 are segmented in the vertical direction in a plural manner.

Figure 8:
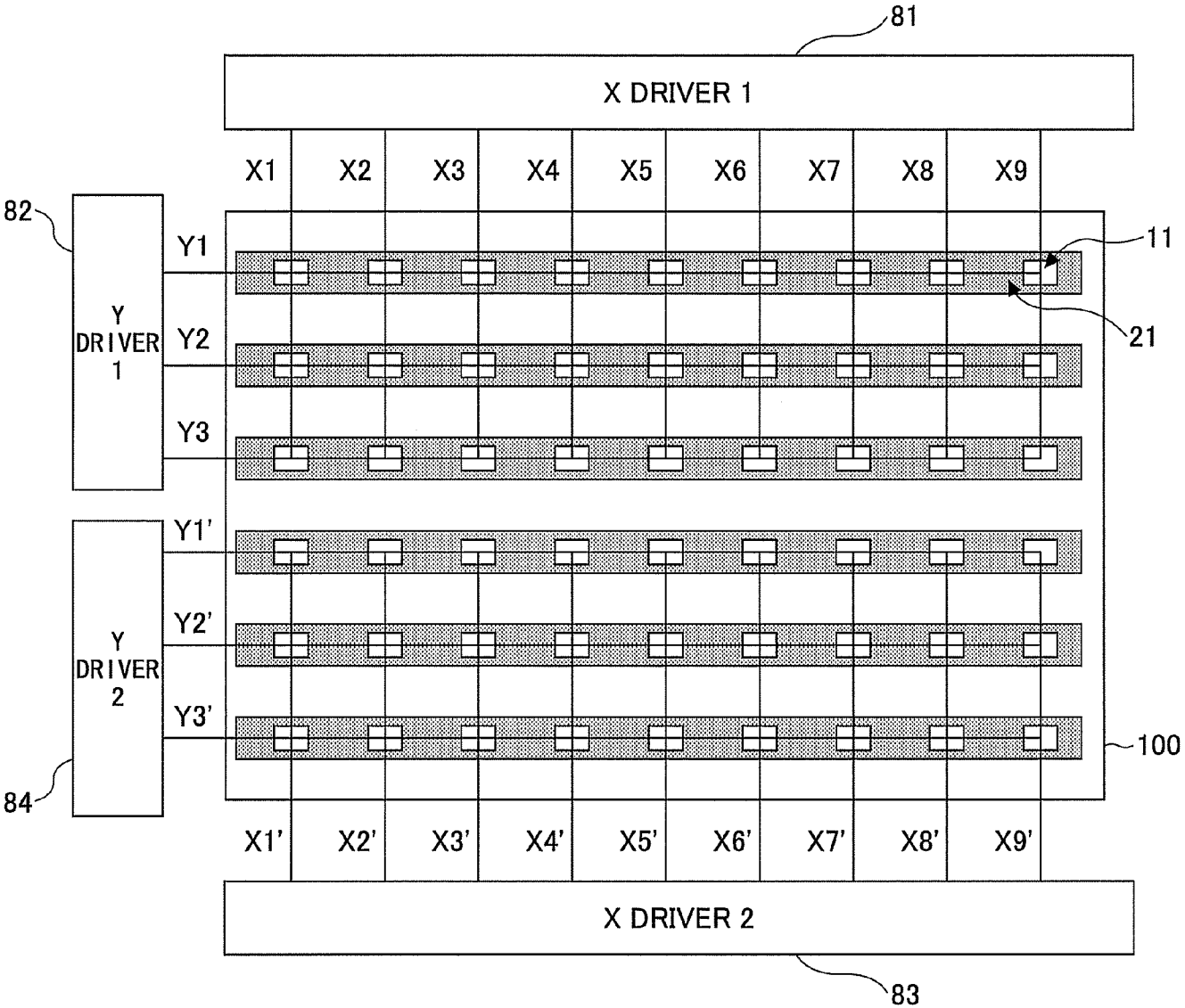
FIG. 8 is a view showing a case where the backlight is segmented into plural regions in the vertical direction in the backlight device of the present invention.

FIG. 8 is a view showing a case where the backlight is segmented into plural regions in the vertical direction in the backlight device of the present invention. An example where six lines 21 are divided into two regions is shown in FIG. 8. In this example, a first Y driver 82 and a second Y driver 84 are driving circuits in the vertical direction and can be driven independently of each other. The first Y driver 82 and the second Y driver 84 may be three-step ring counters where there is no brightness problem because the duty pulse of the driving counter is 33%.

Figure 9A:
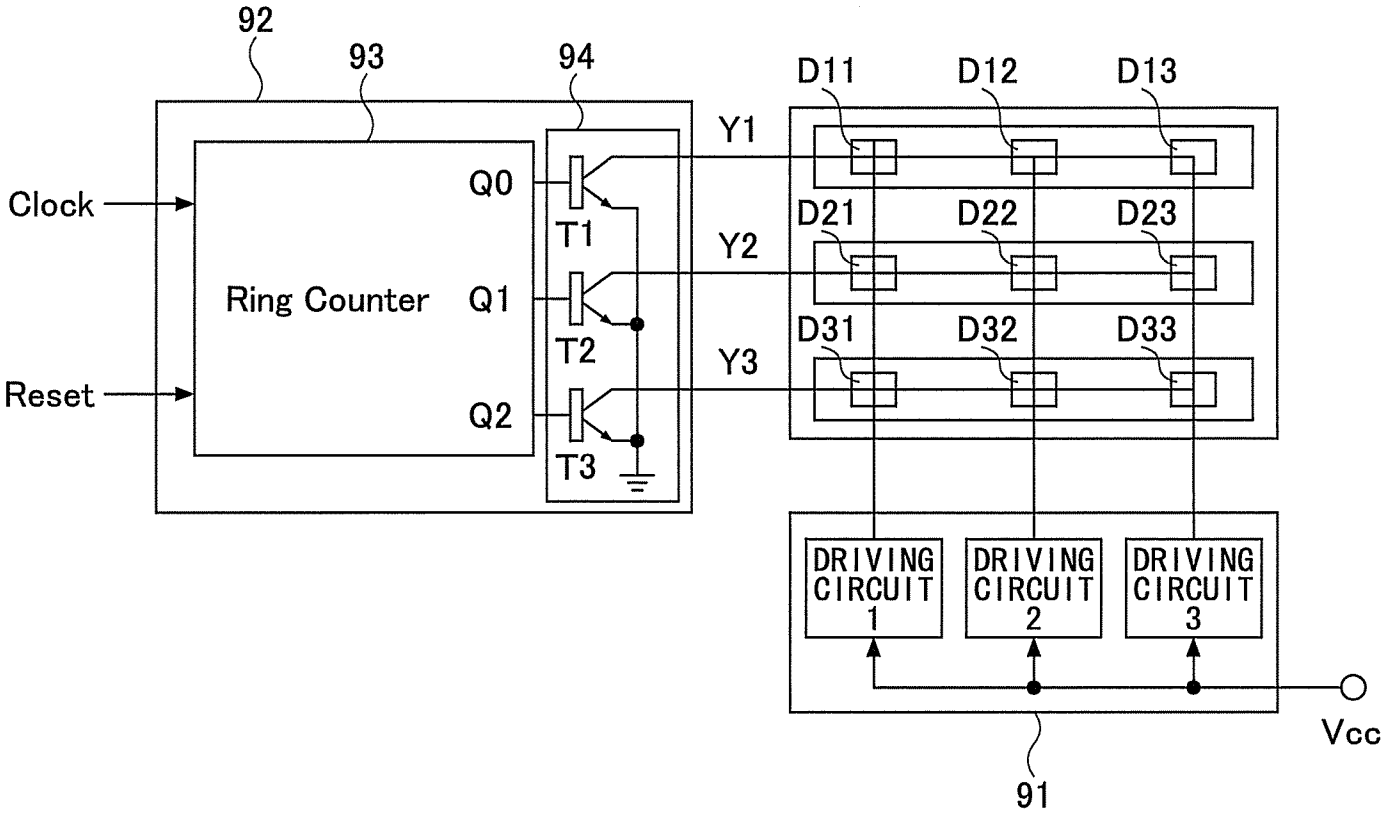
FIG. 9A is a view showing an example of structures of a horizontal direction driving circuit X driver 91 and a vertical direction driving circuit Y driver 92.

Next, entire operations including the horizontal direction driving circuit X driver are briefly discussed as an example of a line order method of the embodiment of the present invention. FIG. 9A is a view showing an example of structures of a horizontal direction driving circuit X driver 91 and vertical direction driving circuit Y driver 92. For the purpose of making explanation easy, as shown in FIG. 9A, in this example, three light emitting diodes 11 are provided at each of three lines. A line Y1 of the vertical direction driving circuit Y driver 92 is connected to cathodes of the light emitting diodes D11, D12, and D13. Similarly, a line Y2 is connected to cathodes of the light emitting diodes D21, D22, and D23. A line Y3 is connected to cathodes of the light emitting diodes D31, D32, and D33. In addition, a driving circuit 1 in the horizontal direction driving circuit X driver 91 is connected to the light emitting diodes D11, D21, and D31. Similarly, a driving circuit 2 is connected to the light emitting diodes D12, D22, and 032. A driving circuit 3 is connected to the light emitting diodes D13, D23, and D33.

In the example shown in FIG. 9A, when the line Y1 is selected by the ring counter 93, a transistor T1 of the drive amplifier 94 is turned on, so that all of the light emitting diodes D11, D12, and D13 on the line Y1 are grounded. On the other hand, anodes of the light emitting diodes D11, D12, and D13 are connected to the driving circuits 1, 2, and 3. Since each of the driving circuits can independently control electrical currents supplied to each of the corresponding light emitting diodes, it is possible to independently change the brightness of the light emitting diodes D11, D12, and D13 on the line Y1. Similarly, by selecting the lines Y2 and Y3 in order, it is possible to control the brightness of the backlight in the vertical direction with line gaps and in the horizontal direction with light emitting diode units.

Figure 9B:
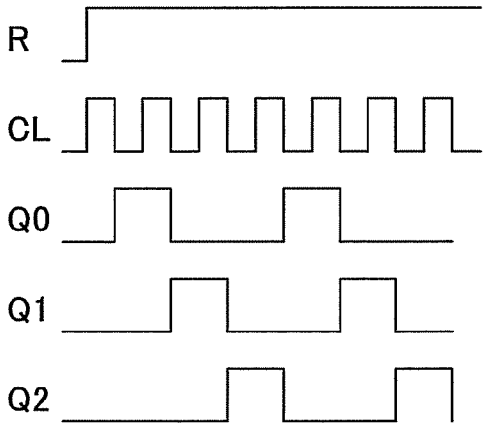
FIG. 9B is a view showing an example of an operations signal of the ring counter 93 in a case where the vertical direction driving circuit Y driver 92 is driven by a line order method.

FIG. 9B is a view showing an example of an operations signal of the ring counter 93 in a case where the vertical direction driving circuit Y driver 92 is driven by the line order method. As shown in FIG. 9B, at the timing when the level of the clock signal CL is changed from high to low after a reset signal R and a clock signal CL are input to the ring counter 93, the ring counter 93 makes outputs Q0, Q1, and Q2 while the outputs Q0, Q1, and Q2 are shifted in order. For example, the vertical direction driving circuit Y driver 92 may be driven in order by an output signal of the ring counter 93.

In addition, it is general practice to use a constant current circuit or a PWM (Pulse Width Modulation) circuit as the driving circuits 1, 2 and 3 of the horizontal direction driving circuit X driver 91. However, the present invention is not limited to the above-discussed circuits.

Figure 10A:
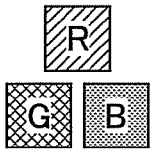
FIG. 10A is a view showing an example in a case where a set of a single red light emitting diode, a single green light emitting diode, and a single blue light emitting diode is used.
Figure 10B:
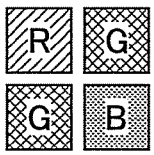
FIG. 10B is a view showing an example in a case where a set of a single red light emitting diode, two green light emitting diodes, and a single blue light emitting diode is used for the light emitting diode 11.

Although the white light emitting diode is used in the light emitting diode 11 for the light source in the above-mentioned examples, a color light emitting diode may be used. FIG. 10A shows an example where a set of a single red (R) light emitting diode, a single green (G) light emitting diode, and a single blue (B) light emitting diode, instead of the white light emitting diode, is used. FIG. 10B is a view showing an example where a set of a single red (R) light emitting diode, two green (G) light emitting diodes, and a single blue (B) light emitting diode, instead of the white light emitting diode 11, is used. A combination of the color light emitting diodes is not limited to the above-mentioned example. The white light emitting diode and the color light emitting diode may be combined (not illustrated).

Next, an example of control when the size of the region to be segmented is optionally set based on the contents of the image signal is discussed with reference to FIG. 11 through FIG. 14.

Figure 11:
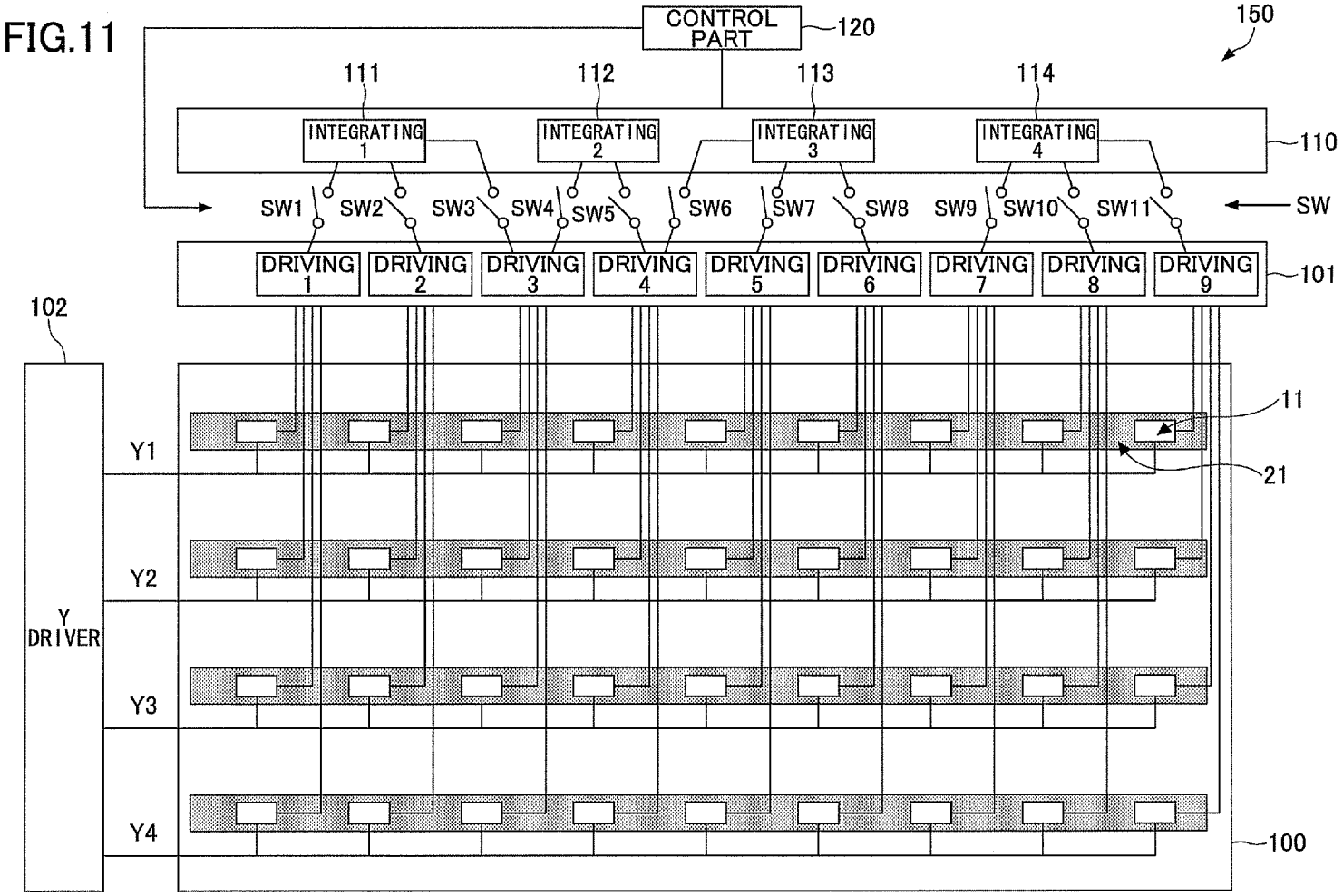
FIG. 11 is a view showing a driving structure of a backlight device of an embodiment where a size of a region to be segmented can be optionally set.

FIG. 11 is a view showing a driving structure of a backlight device of an embodiment where a size of a region to be segmented can be optionally set. The backlight device shown in FIG. 11 includes the light emitting diodes 11 provided on the backlight board 100. The light emitting diodes 11 form the lines 21 extending in the horizontal direction. The lines 21 are arranged in parallel in the vertical direction with designated gaps.

An X driver 101 and a Y driver 102 are provided so as to drive the light emitting diodes 11. The Y driver 102 drives the light emitting diodes 11 in line 21 units. The X driver 101 is configured to individually drive the light emitting diodes 11. In addition, the backlight device of the embodiment of the present invention includes a segmented region setting part 150 configured to set the segmented regions. The segmented region setting part 150 includes an integrating part 110, a control part 120, and switches SW.

Arrangement of the light emitting diodes 11 and a driving method of the Y driver 102 are the same as the operation of the backlight device shown in FIG. 5 and therefore explanation thereof is omitted. Driving circuits 1 through 9 are provided in the X driver 101 for corresponding vertical lines so that individual control can be made for every line. If, for example, driver ICs (Integrated Circuits) having four output terminals are applied to the driving circuits 1 through 9, it is possible to independently control the light emitting diodes 11 of the same line and Y1 through Y4 rows. Accordingly, in the normal state, as discussed with reference to FIG. 3, it is possible to control the brightness with an individual light emitting diode 11 unit. Hence, the region segmentation which is the same as the region segmentation 31 shown in FIG. 3 can be set.

Figure 12:
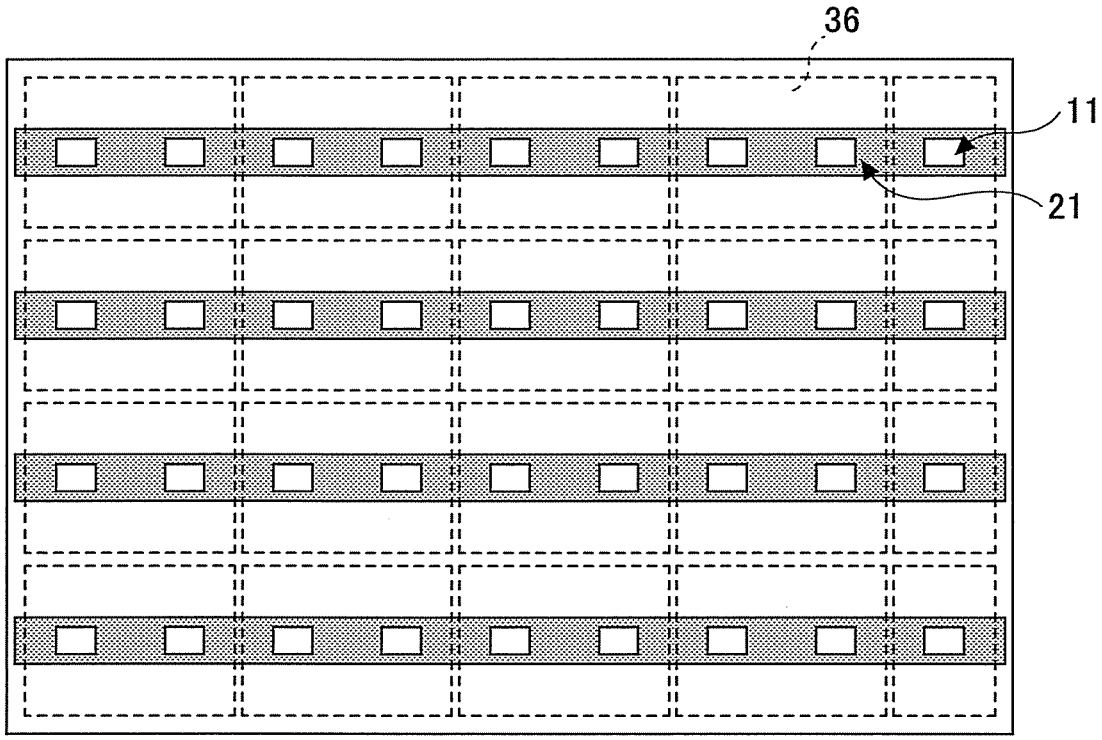
FIG. 12 is a view showing an example where a backlight board 100 is segmented by a size of region segmentation different from the example shown in FIG. 3.

FIG. 12 is a view showing an example where a backlight board 100 is segmented by a size region segmentation 36 different from the example shown in FIG. 3 and FIG. 4. In FIG. 12, the size of the region segmentation 36 is set in a state where neighboring two light emitting diodes 11 provided on the same line 21 are used as a single set. In a case where, as shown in FIG. 3, individual segmentation is not necessary, and lighting of the light emitting diodes 11 may be controlled, for example as shown in FIG. 12, by setting the region segmentation 36 with two light emitting diodes 11 as a single set.

Referring back to FIG. 11, when the region segmentation shown in FIG. 12 is set, the switches SW1, SW2, SW4, SW5, SW7, SW8, SW9, and SW10 are turned on; the switches SW3, SW6, and SW11 are turned off; the driving circuit 1 and the driving circuit 2 are connected to the first integrating part 111; the driving circuit 3 and the driving circuit 4 are connected to the second integrating part 112; the driving circuit 5 and the driving circuit 6 are connected to the third integrating part 113; and the driving circuit 7 and the driving circuit 8 are connected to the fourth integrating part 114. By these connections so that the driving control signal is output from the control part 120 to the integrating parts 111 through 114, the driving circuits 1 through 9 integrated by the integrating parts 111 through 114 can perform driving control by using two light emitting diodes 11 neighboring on the line 21 as the region segmentation. In other words, the driving control can be performed with the region segmentation 36 shown in FIG. 12. The switching control of the switches SW may be performed by the control part 120.

Next, a case, as shown in FIG. 4, where the region segmentation 41 is set by three diodes 11 on the same line 21 is discussed. In this case, the switches SW1, SW2, SW3, SW6, SW7, SW8, SW9, SW10, and SW11 are turned on, and the switches SW4 and SW5 are turned off. As a result of this, the driving circuits 1 through 3 are connected to the first integrating part 111; the driving circuits 4 through 6 are connected to the third integrating part 113; and the driving circuits 7 through 9 are connected to the fourth integrating part 114. The driving circuits 1 through 9 are not connected to the second integrating circuit 112. In this connecting state, if the driving control signal is output from the control part 120 to the first integrating part 111, the third integrating part 113, and the fourth integrating part 114, as shown in FIG. 4, three light emitting diodes 11 on the same line 21 can be driven as a unit of the region segmentation. In this case, the switching control of the switch SW may be performed by the control part 120.

Thus, by properly integrating the driving circuits 1 through 9 based on the setting of the region segmentation, the size of the region segmentation can be properly changed, if necessary. Although the example where the X driver 101 is segmented and integrated is discussed with reference to FIG. 11, the Y driver 102 may be segmented and integrated.

Figure 13:
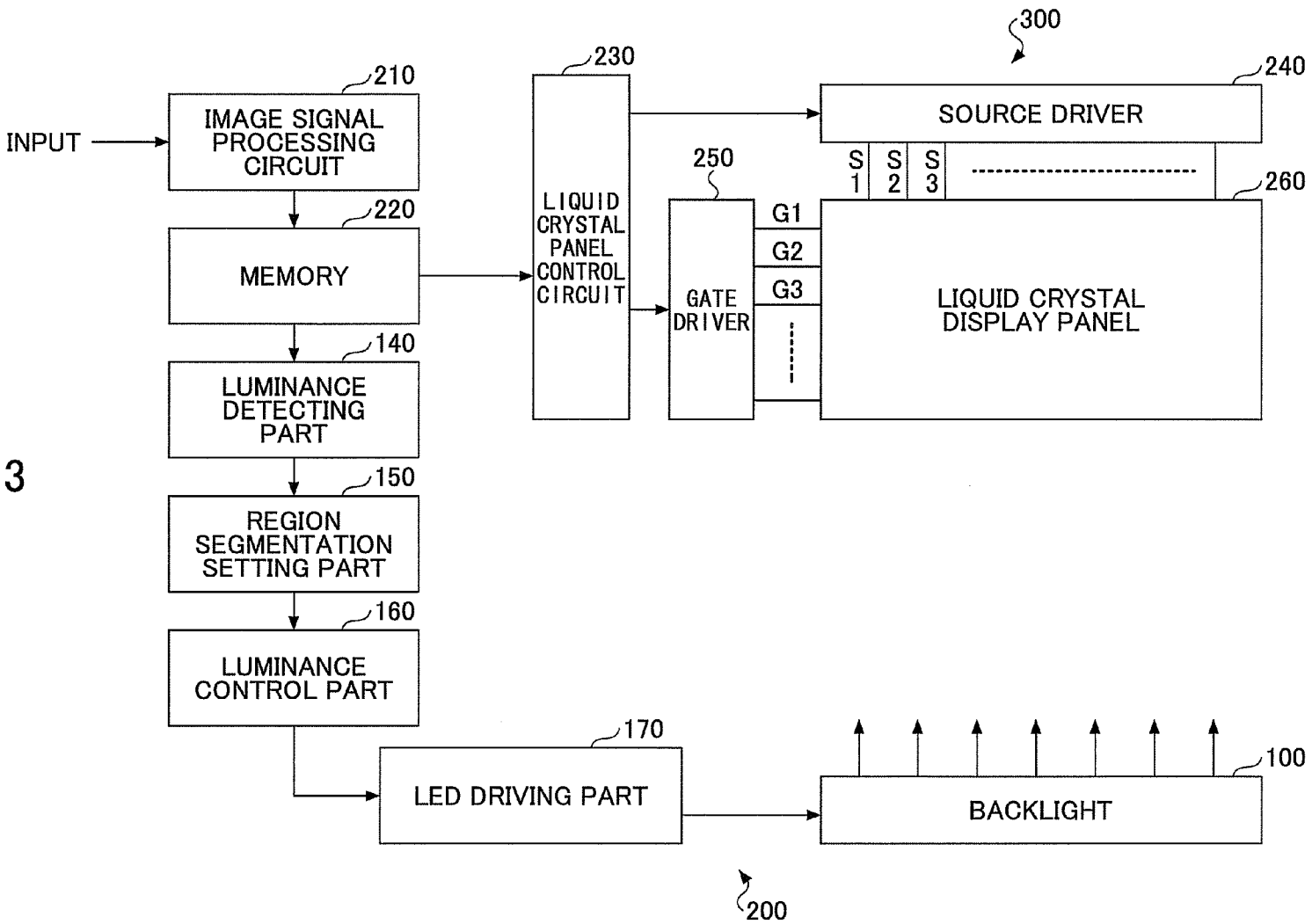
FIG. 13 is an entire structural view of the backlight device 200 and the liquid crystal displaying device 300 using the backlight device 200 of the embodiment of the present invention.

Next, an example where a backlight device having the above-discussed driving circuit is applied to a liquid crystal displaying device and the setting of the region segmentation is changed based on the contents of the image signal is discussed with reference to FIG. 13 and FIG. 14. FIG. 13 is an entire structural view of the backlight device 200 and the liquid crystal displaying device 300 using the backlight device 200 of the embodiment of the present invention.

Referring to FIG. 13, the backlight device 200 of the embodiment of the present invention includes a luminance detecting part 140, a region segmentation setting part 150, a luminance control part 160, a light emitting diode control part 170, and a backlight board 100. In addition, the liquid crystal displaying device 300 being a subject of application of the backlight device 200 of the embodiment includes an image signal processing circuit 210, a memory 220, a liquid crystal panel control circuit 230, a source driver 240, a gate driver 250, and a liquid crystal display panel 260.

First, the liquid crystal display device 300 is discussed. The image signal processing circuit 210 is configured to perform a process necessary for displaying an image of an image signal when the image signal is input. The memory 220 is a storing part configured to store the processed image signal for a while. The liquid crystal panel control circuit 230 is configured to control image displaying of the crystal display panel 260. The liquid crystal panel control circuit 230 directly controls driving of the source driver 240 and the gate driver 250 so as to control, for example, timing of horizontal synchronization and vertical synchronization. The source driver 240 is a driving IC configured to drive the source of a thin-film transistor forming a pixel of the crystal display panel 260 and configured to supply a data signal to the source. In addition, the gate driver 250 is a driving IC configured to drive a gate of the above-mentioned thin-film transistor and configured to supply an address signal (order scanning signal) to the gate. The liquid crystal display panel 260 is configured to display the input image on a display screen. The liquid crystal display panel 260 is provided so as to face a front surface of the backlight device 200. The liquid crystal display panel 260 is driven by the source driver 240 and the gate driver 250 and displays an image by being irradiated from the rear surface by the backlight device 200.

Next, the backlight device 200 of the embodiment of the present invention is discussed with reference to FIG. 13. The image signal having been input to the image signal processing circuit 210 is input to the luminance detecting part 140 via the memory 220. The luminance detecting part 140 is configured to detect, analyze, and recognize the luminance of the image signal. The luminance detecting part 140 detects luminance distribution of the image signal by using, for example, a luminance histogram or average luminance.

Figure 14:
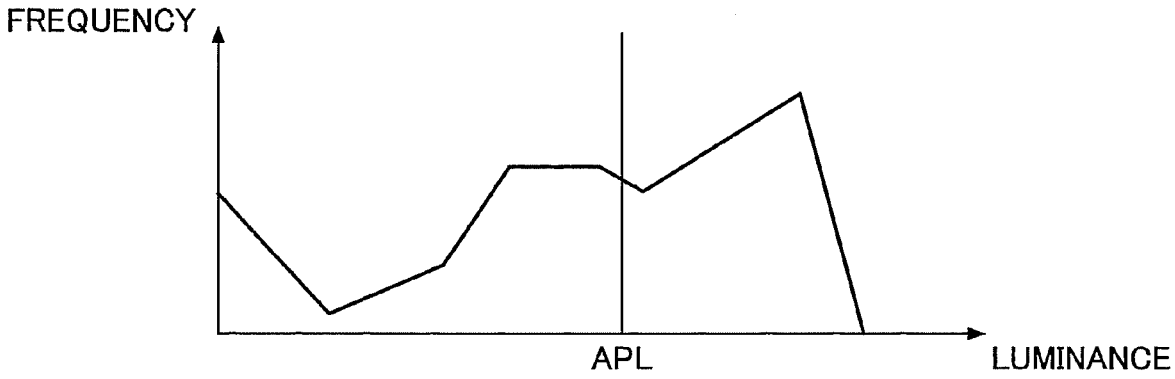
FIG. 14 is a view showing an example of a luminance histogram and average luminance detected by a luminance detecting part.

FIG. 14 is a view showing an example of the luminance histogram and the average luminance detected by the luminance detecting part. In FIG. 14, a horizontal axis denotes luminance [cd/m2] and a vertical axis denotes frequency. In addition, an average luminance APL is also shown in FIG. 14. For example, in a case of a bright image, there is high frequency of an area where luminance is high. In a case of a dark image, there is low frequency of a left side area where luminance is low. It is possible to recognize the luminance distribution or luminance average APL of the unit by calculating this, for example, for every unit. The luminance detecting part 140 detects luminance of the image signal by, for example, the above-mentioned method. Various methods may be applied as a method of detecting luminance as long as luminance in the image signal can be recognized.

Referring back to FIG. 13, the segmented region setting part 150, based on luminance information detected by the luminance detecting part 140, determines the size of the segmented region and performs switch control of changing of the segmented region. For example, in a case where it is found, via luminance information detected by the luminance detecting part 140, the luminance of the image in a certain area is relatively lower than the periphery, the segmented region setting part 150 performs a computing process whereby an entire area of the light emitting diodes 11 included in the area where the luminance is low is segmented. For example, a computing process mentioned below may be performed. That is, when the luminance of the image signal for every segmented region or corresponding to each pixel is detected, the difference of luminance of neighboring segmented regions or each pixel is calculated so that the segmented regions or the pixels where the difference of luminance is equal to or lower than the designated value are collected. The segmented region setting part 150 may include an electronic circuit, a CPU (Central Processing Unit), a RAM (Random Access Memory), a ROM (Read Only Memory), and others whereby the above-mentioned computing process can be performed. The segmented region setting part 150 may be formed as a microcomputer operated by a program.

In addition, the segmented region setting part 150 may set the segmented region based on the ratio of a large area part in the image signal or the quantity of high frequency components. For example, in a case where a display subject is large so that the large area part is formed and the ratio of the large area part is high in the image signal, the segmented region may be set by performing segmentation where the large area part is included so that the large area is collected, so that it is possible to perform proper control of the luminance of the segmented region based on the luminance of the display subject. In addition, in a case where the region where the high frequency components are largely contained exists in the image signal, the region may be displayed in a dazzling manner and the quantity of noise may be large. Hence, in this case, the segmented region including a region where a large number of high frequency components are included may be set so that it is possible to turn the luminance down. In addition, the ratio of the large area in the image signal and determination based on the quantity of the high frequency components may be combined.

After performing the computing process of setting of the segmented region, the segmented region setting part 150 performs switch SW control for switching the control so that the light emitting diode driving part 170 operates with a designated segmented region unit. As discussed with reference to FIG. 11, for example, the switch SW control part may switch the driving area of the X driver 101 or the Y driver 102 which is a part of the light emitting diode driving part 170, by using the control part 120, the integrating part 110, and other parts. Since the explanation of its control operation is already provided with reference to FIG. 11, details of the explanation thereof are omitted here.

The luminance control part 160 performs the luminance control independently with respect to each of the segmented regions determined by the segmented region setting part 150. The luminance control part 160, based on the luminance information including the luminance distribution detected by the luminance detecting part 140 and the information of the setting of the segmented region set by the segmented region setting part 150, controls so that each of the segmented regions is driven with a proper luminance. In other words, the control is performed, so that the light emitting diodes 11 are driven with low luminance in the segmented region where the luminance of the image signal is low and thereby electric power saving is achieved; and the light emitting diodes 11 are driven with high luminance in the segmented region where the luminance of the image signal is high and thereby a high quality image can be obtained. For example, in a case where the driving circuit included in the light emitting diode driving part 170 is a constant electrical current circuit, the luminance of the light emitting diode 11 may be adjusted with a supplied electrical current. In a case where the driving circuit is a pulse width modulation (PWM) circuit, the luminance is adjusted by adjusting the duty ratio.

In addition, as discussed above, in a case where the segmented region is set based on the ratio of a large area part in the image signal, the luminance control may be performed so that this is properly displayed based on the luminance of the image signal of the display subject of the segmented region. In a case where the segmented region is set based on the quantity of high frequency components, if the quantity of the high frequency components is large, the luminance may be turned down so that the dazzling or noise can be prevented. In a case where the quantity of the high frequency components is small, for example, the luminance of the light emitting diodes 11 may be controlled based on the luminance of the normal image. These controls may be combined. For example, in a case where the display subject occupying a large area has high luminance, the light emitting diodes 11 are controlled with high luminance based on this. In a case where a large quantity of high frequency components is detected, a viewer may feel dazzled and therefore it is possible to perform correction control so that the luminance is slightly lowered. Thus, the luminance control part 160 can perform proper and various controls of the segmented region based on the contents of the image signal.

The light emitting diode driving part 170 is configured to drive the light emitting diodes 11 provided on the backlight board 100 so that the light emitting diodes 11 are lighted. The light emitting diode driving part 170 includes the above-mentioned X drivers 51, 61, 81, 83, 91, and 101 and Y drivers 52, 62, 72, 82, 84, 92, and 102 and other parts. The light emitting diode driving part 170 includes a driving circuit configured to drive a minimum unit of the segmented region of the light emitting diodes 11. It is possible to form a large segmented region by connecting the driving circuit to the peripheral segmented region. Details of this have already been discussed with reference to FIG. 11 and explanation thereof is omitted.

Plural light emitting diodes 11 are provided on the surface of the backlight board 100. The light is irradiated onto the rear surface of the liquid crystal display panel 260 by the light emitting diodes 11. Accordingly, the light emitting diodes 11 are supported and arranged by the backlight board 100.

In the backlight device 200 having the above-discussed structure and the liquid crystal displaying device 300 using the backlight device 200, by setting the segmented regions based on the contents of the image signal, especially the luminance of the image signal so that the luminance control is made with the segmented region units, it is possible to perform proper luminance control based on the contents of the image signal. As a result of this, the luminance in the block of the dark image signal is lowered so that electric power can be made low and the luminance in the block of the bright image signal is raised so that the high quality image can be displayed.

As for detailed settings of the segmented region, as discussed with reference to FIG. 11, by setting so that the minimum segmented region is integrated, it is possible to realize the proper lighting control of the light emitting diodes 11 for the image signal variously changing by flexible and simple switching control.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

INDUSTRIAL APPLICABILITY

The present invention is applicable to a backlight device configured to irradiate light onto a rear surface of a liquid crystal display panel and an image displaying device, such as a liquid crystal display, using the backlight device.

This application claims priority based on Japanese Patent Application No. 2007-294189 filed in Japan on Nov. 13, 2007 and Japanese Patent Application No. 2008-270221 filed in Japan on Oct. 20, 2008. The foregoing applications are hereby incorporated herein by reference.

The invention claimed is:

1. A backlight device which uses a light emitting diode as a light source, the back light device being configured to irradiate a liquid crystal display panel from a rear surface of the liquid crystal display panel, the backlight device having a structure where plural lines are provided on a backlight board with a certain gap, each of the lines being formed by a plurality of the light emitting diodes, the backlight device comprising:

a light emitting diode driving part configured to segment an entire screen of the backlight board into plural segmented regions and configured to independently control brightness of the light emitting diodes with a segmented region unit, and a segmented region setting part configured to optionally set a size of the segmented region, wherein the segmented region setting part is configured to set the size of the segmented region so as to change the size of the segmented region based on contents of an image signal;

the backlight device further comprises a luminance control part configured to control brightness of the segmented region based on the contents of the image signal, and a luminance detecting part configured to detect luminance distribution of the image signal by using at least one of luminance histogram and average luminance, wherein the luminance control part is configured to control to drive the light emitting diodes with low luminance in the segmented region having low luminance of the image signal, and to drive the light emitting diodes with high luminance in the segmented region having high luminance of the image signal based on luminance information including the luminance distribution detected by the luminance detecting part and information of the segmented region set by the segmented region setting part, and wherein the backlight device further comprises:

a plurality of driving circuits provided to each of horizontal direction lines of the light emitting diodes;

a plurality of integrating parts, each of the plurality of the integrating parts configured to control two or more driving circuits among the plurality of driving circuits so as to turn on the two or more driving circuits together;

a plurality of switches, each of the plurality of the switches configured to connect the each of the plurality of integrating parts and each of the two or more driving circuits; and a control part configured to control a connecting relationship between the each of the integrating parts and the two or more driving circuits via said each of the plurality of the switches, wherein at least one of the driving circuits is connectable to a first integrating part and a second integrating part of the plurality of integrating parts via the switches.

2. The backlight device as claimed in claim 1, wherein the light emitting diode is formed by a combination of a white light emitting diode, a red light emitting diode, a green light emitting diode and/or a blue light emitting diode.

3. A liquid crystal displaying device, comprising:

the backlight device as claimed in claim 1;

a liquid crystal display panel provided at a front surface of the backlight device, the liquid crystal display panel being configured to display an image in a state where the liquid crystal display panel is irradiated by the backlight device;

a source driver and a gate driver configured to drive the liquid crystal display panel; and a liquid crystal panel control circuit configured to control driving of the source driver and the gate driver.

4. The backlight device as claimed in claim 1, further comprising a ring counter configured to select the lines to be turned on.

5. The backlight device as claimed in claim 1, wherein the control part is further configured to determine which one of the first and second integrating parts is connected to said at least one of the driving circuits based on the size of the segment region set by the segment region setting part.

* * * * *